US010570478B2

(12) United States Patent
Sasaki et al.

(10) Patent No.: US 10,570,478 B2
(45) Date of Patent: Feb. 25, 2020

(54) STEEL FOR MECHANICAL STRUCTURE FOR COLD WORKING, AND METHOD FOR PRODUCING SAME

(71) Applicant: KOBE STEEL, LTD., Kobe-shi (JP)

(72) Inventors: Yuki Sasaki, Hyogo (JP); Takehiro Tsuchida, Hyogo (JP); Takuya Kochi, Hyogo (JP); Koji Yamashita, Hyogo (JP); Masamichi Chiba, Hyogo (JP); Kei Masumoto, Hyogo (JP); Masayuki Sakata, Hyogo (JP)

(73) Assignee: KOBE STEEL, LTD., Kobe-shi (JP)

( * ) Notice: Subject to any disclaimer, the term of this patent is extended or adjusted under 35 U.S.C. 154(b) by 524 days.

(21) Appl. No.: 15/319,115

(22) PCT Filed: Jun. 8, 2015

(86) PCT No.: PCT/JP2015/066472
§ 371 (c)(1),
(2) Date: Dec. 15, 2016

(87) PCT Pub. No.: WO2015/194411
PCT Pub. Date: Dec. 23, 2015

(65) Prior Publication Data

US 2017/0130295 A1 May 11, 2017

(30) Foreign Application Priority Data

Jun. 16, 2014 (JP) ..... 2014-123430
Mar. 19, 2015 (JP) ..... 2015-056664

(51) Int. Cl.

| | |
|---|---|
| ***C22C 38/04*** | (2006.01) |
| ***C21D 9/52*** | (2006.01) |
| ***C21D 8/06*** | (2006.01) |
| ***C22C 38/18*** | (2006.01) |
| ***B21B 1/22*** | (2006.01) |
| ***C21D 6/00*** | (2006.01) |
| ***C22C 38/00*** | (2006.01) |
| ***C22C 38/02*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/20*** | (2006.01) |

(52) U.S. Cl.
CPC ..... *C21D 9/525* (2013.01); *B21B 1/22* (2013.01); *C21D 6/002* (2013.01); *C21D 6/005* (2013.01); *C21D 6/008* (2013.01); *C21D 8/06* (2013.01); *C21D 8/065* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C22C 38/20* (2013.01); *B21B 2001/225* (2013.01); *C21D 2211/005* (2013.01); *C21D 2211/009* (2013.01)

(58) Field of Classification Search
CPC ..... C22C 38/04
See application file for complete search history.

(56) References Cited

U.S. PATENT DOCUMENTS

2015/0041029 A1 2/2015 Yamashita et al.

FOREIGN PATENT DOCUMENTS

| | | | | |
|---|---|---|---|---|
| JP | 57-89430 | | | 6/1982 |
| JP | 2000-119809 | | | 4/2000 |
| JP | 2000-273580 | | | 10/2000 |
| JP | 3742232 | B2 | | 2/2006 |
| JP | 2013-7088 | | | 1/2013 |
| JP | 2013007090 | A | * | 1/2013 |
| JP | 2013-147728 | | | 8/2013 |
| JP | 2013-227602 | A | | 11/2013 |
| JP | 2014-37592 | | | 2/2014 |
| TW | 201402837 | A | | 1/2014 |

OTHER PUBLICATIONS

English machine translation of JP 2013007088 A of Yamashita published Jun. 23, 2011 (Year: 2011).*
English machine translation of JP 2013007089 A of Masuda published Jun. 23, 2011 (Year: 2011).*
International Search Report dated Sep. 8, 2015 in PCT/JP2015/066472 (with English translation).
Written Opinion dated Sep. 8, 2015 in PCT/JP2015/066472 (with English translation).

* cited by examiner

*Primary Examiner* — Jessee R Roe
*Assistant Examiner* — Jophy S. Koshy
(74) *Attorney, Agent, or Firm* — Oblon, McClelland, Maier & Neustadt, L.L.P.

(57) ABSTRACT

Provided is a steel for a mechanical structure for cold working, which contains C, Si, Mn, P, S, Al and N and in which the metal structure includes pearlite and ferrite, the total areal proportion of pearlite and ferrite relative to the overall structure is 90% or higher, the average circle-equivalent diameter of bcc-Fe crystal grains surrounded by large angle grain boundaries is 5-15 μm, the average aspect ratio of pro-eutectoid ferrite crystal grains is 3.0 or lower, and the average spacing at the narrowest pearlite lamellar spacing is 0.20 μm or less.

19 Claims, 1 Drawing Sheet

STEEL FOR MECHANICAL STRUCTURE FOR COLD WORKING, AND METHOD FOR PRODUCING SAME

TECHNICAL FIELD

The present invention relates to a steel for a mechanical structure for cold working. More specifically, the present invention relates to a steel for a mechanical structure, which exhibits low deformation resistance after spheroidizing annealing and excellent cold workability, and a method for manufacturing the steel for a mechanical structure. The steel for a mechanical structure for cold working of the present invention is suitably used for various components, such as component for automobiles and component for construction machines, manufactured by cold working such as cold forging, cold heading and cold rolling and the form of the steel is not particularly limited and the steel is intended to be used, for example, as a rolled material such as wire rod and steel bar. In the present invention, it is also intended to be used as a drawn wire rod obtained by performing drawing after rolling, i.e., a steel wire. Examples of various components above specifically include a machine component, an electric component, etc., such as bolt, screw, nut, socket, ball joint, inner tube, torsion bar, clutch case, cage, housing, hub, cover, case, receive washer, tappet, saddle, valve, inner case, clutch, sleeve, outer lace, sprocket, core, stator, anvil, spider, rocker arm, body, flange, drum, joint, connector, pulley, metal fitting, yoke, mouthpiece, valve lifter, spark plug, pinion gear, steering shaft and common rail.

BACKGROUND ART

In manufacturing various components such as component for automobiles and component for construction machines, a spheroidizing annealing treatment is usually applied with the purpose of imparting cold workability to a hot-rolled material such as carbon steel and alloy steel. The rolled material after spheroidizing annealing is subjected to cold working, then to machining such as cutting work for forming the material into a predetermined shape, and further to a quenching-tempering treatment for final strength adjustment.

In recent years, from the viewpoint of energy saving, the conditions of spheroidizing annealing are reexamined, and among others, it is demanded to shorten the spheroidizing annealing time. If the time for a soaking treatment in spheroidizing annealing can be reduced to half or less, this can be expected to provide sufficient energy saving.

Shortening of the spheroidizing annealing treatment indicates, for example, to reduce the soaking treatment time from 6 hours to 3 hours or less. In the case of using a conventional steel for a mechanical structure for cold rolling, it is known that when the spheroidizing annealing time is shortened, spheroidization of a carbide cannot be achieved sufficiently.

Several proposals have been made so far with respect to the method for manufacturing a steel wire rod capable of achieving rapid spheroidizing annealing. For example, Patent Document 1 discloses a method for manufacturing a steel wire rod capable of achieving rapid spheroidization, the method including hot finish rolling and then cooling to a range of 600 to 650° C. at a cooling rate of 5° C./sec or more. However, in this technique, the cooling rate in the temperature region of approximately from 720 to 650° C. allowing production/growth of pro-eutectoid ferrite is high (paragraph 0043, etc. of Patent Document 1), and it is considered that refinement of the pro-eutectoid ferrite or increase in the aspect ratio is caused to incur refinement of the microstructure after spheroidizing annealing and in turn, occurrence of hardening due to grain refinement and softening becomes insufficient.

Patent Document 2 discloses a manufacturing method of a steel for a mechanical structure for cold working, the method including finish rolling, cooling to a temperature range of 640 to 680° C. at an average cooling rate of 5° C./sec or more, and cooling for 20 seconds or more at an average cooling rate of 1° C./sec or less. However, since the subsequent cooling condition is standing to cool to room temperature (paragraph 0040 of Patent Document 2), it is considered that refinement of pearlite is insufficient and when the spheroidizing annealing time is shortened, insufficient spheroidization is caused.

Patent Document 3 discloses a manufacturing method of a steel for cold heading, the method including hot rolling and after the termination of rolling, cooling at a cooling rate of 1° C./sec or less. However, since the cooling is very slow cooling even in the temperature region where pearlite precipitation occurs (paragraph 0022 of Patent Document 3), it is considered that the pearlite lamellar interval becomes coarse and when the spheroidizing annealing time is shortened, a sufficiently spheroidized microstructure is not obtained.

PRIOR ART LITERATURE

Patent Document

Patent Document 1: Japanese Patent No. 3742232
Patent Document 2: JP-A-2013-7088
Patent Document 3: JP-A-2000-273580

SUMMARY OF THE INVENTION

Problems that the Invention is to Solve

The present invention has been made under these circumstances, and an object of the present invention is to provide a steel for a mechanical structure for cold rolling, ensuring that even in the case of applying spheroidizing annealing in which the soaking treatment time is shorter than usual, spheroidization equal to or better than ever before can be achieved and the steel can be softened, and a method useful for manufacturing the steel.

Means for Solving the Problems

The present invention which solve the above problems is directed to a steel for a mechanical structure for cold working, comprising, in mass %, C: from 0.3 to 0.6%,
Si: from 0.05 to 0.5%,
Mn: from 0.2 to 1.7%,
P: more than 0% and 0.03% or less,
S: from 0.001 to 0.05%,
Al: from 0.01 to 0.1%, and
N: from 0 to 0.015%, with the remainder being iron and unavoidable impurities, wherein:

the steel has a metal microstructure comprising pearlite and ferrite, with the total area ratio of the pearlite and the ferrite being 90% or more relative to the total microstructure, an average equivalent-circle diameter of a bcc-Fe grain surrounded by a large-angle grain boundary having a misorientation of more than 15° between two neighboring grains is from 5 to 15 μm, an average aspect ratio of a pro-eutectoid ferrite grain is 3.0 or less, and a pearlite lamellar interval in the narrowest part is 0.20 μm or less on average.

In the steel for a mechanical structure for cold working in the present invention, it is preferred to further comprise, if needed, at least one member selected from the group consisting of, in mass %, Cr: more than 0% and 0.5% or less, Cu: more than 0% and 0.25% or less, Ni: more than 0% and 0.25% or less, Mo: more than 0% and 0.25% or less, and B: more than 0% and 0.01% or less.

In the steel for a mechanical structure for cold working in the present invention, it is preferred that an area ratio Af of pro-eutectoid ferrite, in terms of the percentage relative to the total microstructure, has a relationship of Af≤A with A represented by the following formula (1):

$$A=(103-128\times[C\%])\times 0.65(\%) \quad (1)$$

wherein in the formula (1), [C%] indicates the C content in mass %. The above purpose would be achieved by this embodiment, and it is possible to further attain softening after spheroidizing annealing.

In the present invention, a method for manufacturing the above-described steel for a mechanical structure for cold working is encompassed. More specifically, the method comprises:

performing finish rolling of the steel having the chemical component composition described above at a temperature of 800° C. or more and less than 1,100° C.;

performing, in the following order, first cooling at an average cooling rate of 7° C./sec or more, second cooling at an average cooling rate of 1° C./sec or more and 5° C./sec or less, and third cooling at an average cooling rate of higher than that in the second cooling and 5° C./sec or more; and performing termination of the first cooling and start of the second cooling in the range of 700 to 750° C., performing termination of the second cooling and start of the third cooling in the range of 600 to 650° C., and performing termination of the third cooling at 400° C. or less.

In the present invention, a method for manufacturing the steel for a mechanical structure for cold working which satisfies the relationship of Af≥A among the above-described steel for a mechanical structure for cold working is encompassed. More specifically, the method comprises:

performing finish rolling of the steel having the chemical component composition described above at a temperature of 800° C. or more and less than 1,100° C.;

performing, in the following order, first cooling at an average cooling rate of 7° C./sec or more, second cooling at an average cooling rate of 1° C./sec or more and 5° C./sec or less and not more than CR° C./sec represented by the following formula (2), and third cooling at an average cooling rate of higher than that in the second cooling and 5° C./sec or more; and performing termination of the first cooling and start of the second cooling in the range of 700 to 750° C., performing termination of the second cooling and start of the third cooling in the range of 600 to 650° C., and performing termination of the third cooling at 400° C. or less:

$$CR=-0.06\times T-60\times[C\%]+94(^\circ\ C./sec) \quad (2)$$

wherein in the formula (2), T indicates the temperature (° C.) of the finish rolling, and [C%] indicates the C content in mass %.

In the present invention, a steel wire obtained by further applying drawing to the steel for a mechanical structure for cold working as described above is encompassed.

In addition, the present invention encompasses a method for manufacturing the steel wire as described above, the method comprising subjecting the steel for a mechanical structure for cold working manufactured by the method as described above to drawing work with an area reduction ratio of 30% or less.

Advantage of the Invention

According to the steel for a mechanical structure for cold working of the present invention, the chemical component composition is appropriately adjusted, the total area ratio of pearlite and ferrite relative to the total microstructure is set to be not less than a predetermined value, and each of the average equivalent-circle diameter of a bcc-Fe grain surrounded by a large-angle grain boundary, the average aspect ratio of a pro-eutectoid ferrite grain, and the pearlite lamellar interval in the narrowest part is set to an appropriate range, so that even when the soaking treatment time in spheroidizing annealing is shorter than usual, a spheroidizing degree equal to or better than ever before can be obtained and softening can be achieved. Accordingly, during the manufacture of the above-described various components for a mechanical structure at room temperature as well as in the processing heat generation region after spheroidizing and annealing, the steel for a mechanical structure for cold working of the present invention can exert excellent cold workability by exhibiting low deformation resistance and suppressing cracking of a die or a material.

MODE FOR CARRYING OUT THE INVENTION

Figure 1A:
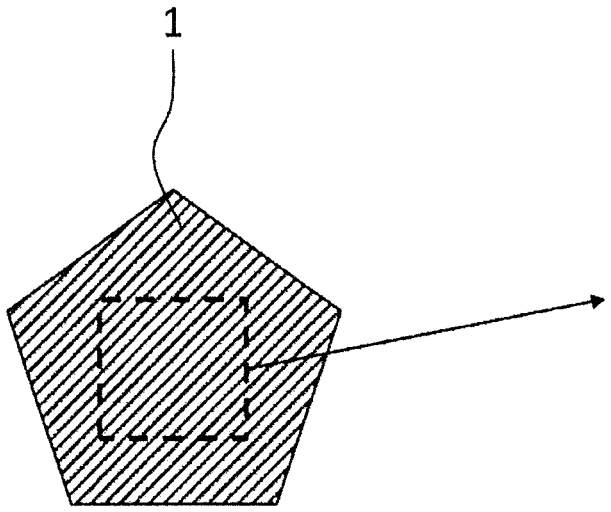
FIG. 1A and FIG. 1B are explanatory views for illustrating the method for measuring the pearlite lamellar interval in the narrowest part.

The present inventors have made studies from various viewpoints so as to realize a steel for a mechanical structure for cold working, ensuring that even when spheroidizing annealing with a shorter soaking treatment time than usual (hereinafter, sometimes referred to as "short-time spheroidizing annealing") is applied, a spheroidizing degree equal to or better than ever before can be obtained and softening can be achieved. As a result, they have gained an idea that for achieving spheroidization of carbide even by short-time spheroidizing annealing, it is important to refine the austenite grain microstructure during spheroidizing annealing, increase the grain boundary area, and increase the number of nucleation sites for spheroidized carbide. Then, it has been found that for realizing sufficient spheroidization, after converting the metal microstructure before spheroidizing annealing (hereinafter, sometimes referred to as "pre-microstructure") to a microstructure of which main phase is composed of pearlite and ferrite, when a bcc-Fe grain surrounded by a large-angle grain boundary is made as small as possible and when the pro-eutectoid ferrite grain is equiaxed and the pearlite lamellar interval in the narrowest part is set to be not more than a predetermined value, the spheroidizing degree after spheroidizing annealing can be improved and the hardness can be reduced maximally, and the present invention has been accomplished.

Furthermore, it has been found that the hardness after spheroidizing annealing can be more reduced by increasing the area ratio of pro-eutectoid ferrite. This is described in detail below.

The steel of the present invention has a pearlite microstructure and a ferrite microstructure (having the same meaning as the later-described "pro-eutectoid ferrite"). These microstructures are a metal microstructure contributing to enhancement of cold workability by reducing deformation resistance of steel. However, by only forming a metal microstructure merely containing ferrite and pearlite, the desired softening cannot be achieved. Accordingly, as described below, the area ratio of each of these microstructures and the average grain size of bcc-Fe grain must be appropriately controlled.

In the case where the pre-microstructure before spheroidizing annealing contains a fine microstructure such as bainite and martensite, even if general spheroidizing annealing is performed, the microstructure is locally refined due to the effect of bainite and martensite after spheroidizing annealing, and insufficient softening is caused. From this viewpoint, the total area ratio of pearlite and ferrite relative to the total microstructure must be 90% or more. The total area ratio of pearlite and ferrite is preferably 95% or more, more preferably 97% or more. Examples of the metal microstructure other than pearlite and ferrite include martensite, bainite, etc. which may be produced, for example, in the production process, but since an increase in the area ratio of such a microstructure may lead to high strength and in turn, deterioration of cold workability, such a microstructure may not be contained at all. Accordingly, the total area ratio of pearlite and ferrite relative to the total microstructure is most preferably 100%.

When the average equivalent-circle diameter of a bcc (body-centered cubic)-Fe grain (hereinafter, sometimes simply referred to "average bcc-Fe grain size") surrounded by a large-angle grain boundary in the pre-microstructure is set to be 15 μm or less, a sufficient spheroidizing degree can be achieved even after short-time spheroidizing annealing. When the spheroidizing degree can be reduced, this contributes to softening, and the cracking resistance during cold working is enhanced. The average bcc-Fe grain size is preferably 14 μm or less, more preferably 13 μm or less. However, if the average bcc-Fe grain size in the pre-microstructure is too small, hardening due to grain refinement of the metal microstructure after spheroidizing annealing is caused, and softening becomes difficult. Accordingly, the lower limit of the average bcc-Fe grain size is preferably 5 μm or more, more preferably 6 μm or more, still more preferably 7 μm or more. The equivalent-circle diameter of the grain means the diameter of a circle having the same area as each grain.

The microstructure in which the average bcc-Fe grain size is intended to be controlled is a bcc-Fe grain surrounded by a large-angle grain boundary having a misorientation of more than 15° between two neighboring grains. Because, a small-angle grain boundary having a misorientation of 15° or less is less susceptible to spheroidizing annealing. By controlling the average bcc-Fe grain size surrounded by the large-angle grain boundary to fall in a predetermined range, a sufficient spheroidizing degree can be achieved even by short-time spheroidizing annealing. Here, the "misorientation" is also called "deviation angle" or "oblique angle", and for the measurement of misorientation, an EBSP method (Electron Back Scattering Pattern method) may be employed. In addition, bcc-Fe surrounded by a large-angle grain boundary, of which average grain size is measured, encompasses ferrite contained in the pearlite microstructure, in addition to pro-eutectoid ferrite.

In the steel of the present invention, the average aspect ratio of pro-eutectoid ferrite is 3.0 or less. A grain having a large aspect ratio readily grows in the longitudinal direction, i.e., the major axis direction, and is less likely to grow in the width direction, i.e., the minor axis direction. If the average aspect ratio of pro-eutectoid ferrite is too large, hardening due to grain refinement of the metal microstructure is caused after short-time spheroidizing annealing, and softening becomes insufficient. From such a viewpoint, the average aspect ratio of pro-eutectoid a ferrite grain in the pre-microstructure needs to be 3.0 or less. The average aspect ratio is preferably 2.7 or less, more preferably 2.5 or less. The lower limit of the average aspect ratio is, ideally, preferably 1.0 and is sometimes about 1.5.

As described above, the steel of the present invention has pearlite and ferrite, but when the pearlite configuration is refined, spheroidization of carbide is promoted even in short-time spheroidizing annealing, and a sufficiently spheroidized microstructure is obtained. From such a viewpoint, the pearlite lamellar interval in the narrowest part (hereinafter, simply referred to as "average lamellar interval") in the pre-microstructure must be 0.20 μm or less. The average lamellar interval is preferably 0.18 μm or less, more preferably 0.16 μm or less. The lower limit of the average lamellar interval is not particularly limited but is usually about 0.05 μm.

In the metal microstructure of the steel, when the area ratio of pro-eutectoid ferrite is increased, the number of carbide precipitation sites during spheroidizing annealing is decreased, and reduction in the number density of carbide and coarsening of carbide are promoted. As a result, the distance between carbide grains is increased and a softer microstructure can be obtained. On the other hand, the area ratio of pro-eutectoid ferrite varies due to the effect of the amount of carbon contained, and when the carbon amount increases, the pro-eutectoid ferrite area ratio decreases. The pro-eutectoid ferrite area ratio appropriate to obtain a good spheroidized material varies as well according to the amount of carbon contained, and as the carbon amount is larger, the ferrite area ratio decreases. From such a viewpoint, it has been found by numerous experimental results that when the area ratio Af of pro-eutectoid ferrite, in terms of the percentage relative to the total microstructure in the pre-microstructure, has a relationship of $Af \geq A$ with A represented by the following formula (1), further softening can be achieved.

$$A=(103-128\times[C\%])\times 0.65(\%) \quad (1)$$

In formula (1), [C%] indicates the C content in mass %.

A is preferably $(103-128\times[C\%])\times 0.70$, more preferably $(103-128\times[C\%])\times 0.75$.

The present invention is directed to a steel for a mechanical structure for cold working, and the steel species thereof may be sufficient if it has a chemical component composition commonly employed as a steel for a mechanical structure for cold working, however, C, Si, Mn, P, S, Al and N are preferably adjusted to the following appropriate ranges. In the description of the present invention, with respect to the chemical component composition, "%" means mass %.

C: 0.3 to 0.6%

C is an element useful in securing the strength of steel, particularly the strength of the final product. In order to exert such an effect effectively, the C content must be 0.3% or more. The C content is preferably 0.32% or more, more preferably 0.34% or more. However, if C is contained too much, the strength is increased to deteriorate the cold workability. For this reason, the C content must be 0.6% or less. The content is preferably 0.55% or less, more preferably 0.50% or less.

Si: 0.05 to 0.5%

Si is incorporated as a deoxidizing element with the purpose of increasing the strength of the final product by solid-solution hardening. In order to exert such an effect effectively, the Si content is specified to be 0.05% or more. The Si content is preferably 0.07% or more, more preferably 0.10% or more. On the other hand, if Si is contained too much, the strength is increased excessively to deteriorate the cold workability. For this reason, the Si content is specified to be 0.5% or less. The Si content is preferably 0.45% or less, more preferably 0.40% or less.

Mn: 0.2 to 1.7%

Mn is an element effective in increasing the strength of the final product through enhancement of quenchability. In order to exert such an effect effectively, the Mn content is specified to be 0.2% or more. The Mn content is preferably 0.3% or more, more preferably 0.4% or more. On the other hand, if Mn is contained too much, the hardness increases to deteriorate the cold workability. For this reason, the Mn content is specified to be 1.7% or less. The Mn content is preferably 1.5% or less, more preferably 1.3% or less.

P: more than 0% and 0.03% or less

P is an element unavoidably contained in the steel and causes grain boundary segregation in the steel, giving rise to deterioration of the ductility. Accordingly, the P content is specified to be 0.03% or less. The P content is preferably 0.02% or less, more preferably 0.017% or less, still more preferably 0.01% or less. The P content is preferably as small as possible and is most preferably 0%, but this element sometimes remains (i.e., more than 0%) due to restrictions on the production process, and the extent thereof is, for example, about 0.001%.

S: 0.001 to 0.05%

S is an element unavoidably contained in the steel and is present as MnS in the steel to deteriorate the ductility and therefore, this is an element harmful for cold working. Accordingly, the S content is specified to be 0.05% or less. The S content is preferably 0.04% or less, more preferably 0.03% or less. However, since S has an action of improving machinability, it is useful to incorporate 0.001% or more of the element. The S content is preferably 0.002% or more, more preferably 0.003% or more.

Al: 0.01 to 0.1%

Al is useful as a deoxidizing element and is useful for fixing, as AlN, the solute N present in the steel. In order to exert such an effect effectively, the Al content is specified to be 0.01% or more. The Al content is preferably 0.013% or more, more preferably 0.015% or more. However, if the Al content is too large, $Al_2O_3$ is produced excessively to deteriorate the cold workability. For this reason, the Al content was specified to be 0.1% or less. The Al content is preferably 0.090% or less, more preferably 0.080% or less.

N: 0 to 0.015%

N is an element unavoidably contained in the steel. When solute N is contained in the steel, an increase in the hardness and a decrease in the ductility are caused due to strain aging to deteriorate the cold workability. Accordingly, the N content is specified to be 0.015% or less. The N content is preferably 0.013% or less, more preferably 0.010% or less. The N content is preferably as small as possible and is most preferably 0%, but this element sometimes remains in an amount of about 0.001% due to restrictions on the production process.

The basic components of the steel for a mechanical structure of the present invention are as described above, and the remainder is essentially iron. The term "essentially iron" means that other than iron, trace components such as Sb and Zn are permissible to an extent not impeding the properties of the present invention and unavoidable impurities other than P, S and N, for example, O and H, can be contained.

Furthermore, in the present invention, the following optional elements may be incorporated, if desired, and the properties of the steel are more improved according to the component incorporated.

One or more members selected from the group consisting of Cr: more than 0% and 0.5% or less, Cu: more than 0% and 0.25% or less, Ni: more than 0% and 0.25% or less, Mo: more than 0% and 0.25% or less, and B: more than 0% and 0.01% or less.

All of Cr, Cu, Ni, Mo and B are an element useful for increasing the strength of the final product by enhancing the quenchability of the steel material and, if desired, one element alone or two or more elements thereof are incorporated. The effect above is higher as the content of such an element is increased, and as for the preferable content to effectively bring out this effect, the Cr amount is 0.015% or more, more preferably 0.020% or more; all of the Cu amount, Ni amount and Mo amount are 0.02% or more, more preferably 0.05% or more; and the B amount is 0.0003% or more, more preferably 0.0005% or more.

However, if the contents of Cr, Cu, Ni, Mo and B are too large, the strength is increased excessively to deteriorate the cold workability. Accordingly, the Cr content is preferably 0.5% or less; all of the Cu, Ni and Mo contents are preferably 0.25% or less; and the B content is preferably 0.01% or less. As for the preferable content of such an element, the Cr amount is 0.45% or less, more preferably 0.40% or less; all of the Cu, Ni and Mo amounts are 0.22% or less, more preferably 0.20% or less; and the B amount is 0.007% or less, more preferably 0.005% or less.

In order to manufacture the steel for a mechanical structure for cold working, it is preferable to adjust the finish rolling temperature during hot rolling of a steel satisfying the above-described component composition and to perform the subsequent cooling at a three-step cooling rate and appropriately adjust the cooling rate and the temperature range. Specifically, finish rolling at a temperature of 800° C. or more and less than 1,100° C. is performed, first cooling at an average cooling rate of 7° C./sec or more, second cooling at an average cooling rate of 1° C./sec or more and 5° C./sec or less, and third cooling at an average cooling rate of higher than that in the second cooling and 5° C./sec or more, are performed in this order, termination of the first cooling and start of the second cooling are performed in the range of 700 to 750° C., termination of the second cooling and start of the third cooling are performed in the range of 600 to 650° C., and termination of the third cooling is performed at 400° C. or less. Each of the finish rolling temperature and the first cooling to third cooling is described in detail below.

(a) Finish Rolling Temperature: 800° C. or More and Less Than 1,100° C.

In order for the average bcc-Fe grain size surrounded by a large-angle grain boundary to adjust to 5 to 15 μm, the finish rolling temperature must be appropriately controlled. If the finish rolling temperature is 1,100° C. or more, it is difficult for the average bcc-Fe grain size to adjust to 15 μm or less. However, if the finish rolling temperature is less than 800° C., the average bcc-Fe grain size can be hardly adjusted to 5 μm or more, and therefore, the finish rolling temperature is 800° C. or more. As the lower limit of the finish rolling temperature, it is preferably 900° C. or more, more preferably 950° C. or more. As the upper limit of the finish rolling temperature, it is preferably 1,050° C. or less, more preferably 1,000° C. or less.

(b) First Cooling

In the first cooling starting at the finish rolling temperature of 800° C. or more and less than 1,100° C. and terminating in the temperature range of 700 to 750° C., i.e., in the temperature region where the metal microstructure undergoes grain growth, if the cooling rate is lowered, the bcc-Fe grain may be coarsened, and the average bcc-Fe grain size surrounded by a large-angle grain boundary may exceed 15 μm. Accordingly, the average cooling rate in the first cooling is set to be 7° C./sec or more. The average cooling rate in the first cooling is preferably 10° C./sec or more, more preferably 20° C./sec or more. The upper limit of the average cooling rate in the first cooling is not particularly limited, but it is practically 200° C./sec or less. In the cooling of first cooling, as long as the average cooling rate is 7° C./sec or more, cooling may be performed by changing the cooling rate.

(c) Second Cooling

For equiaxing the pro-eutectoid ferrite grain, i.e., in order for the pro-eutectoid ferrite grain to have an average aspect ratio of 3.0 or less, in the second cooling starting in the temperature range of 700 to 750° C. and terminating in the temperature range of 600 to 650° C., i.e., in the temperature region where pro-eutectoid ferrite precipitates, slow cooling is performed at an average cooling rate of 5° C./sec or less. On the other hand, if the average cooling rate in the second cooling is too low, the bcc-Fe grain may be coarsened, and the average bcc-Fe grain size surrounded by a large-angle grain boundary may exceed 15 μm. Accordingly, the average cooling rate in the second cooling is set to be 1° C./sec or more. The lower limit of the average cooling rate in the second cooling is preferably 2° C./sec or more, more preferably 2.5° C./sec or more. The upper limit of the average cooling rate in the second cooling is preferably 4° C./sec or less, more preferably 3.5° C./sec or less.

(d) Third Cooling

In order for the average pearlite lamellar interval to adjust to 0.20 μm or less, in the third cooling starting in the temperature range of 600 to 650° C. and terminating at 400° C. or less, i.e., in the temperature region where pearlite transformation occurs, cooling is performed at an average cooling rate that is higher than in the second cooling and is 5° C./sec or more. If the cooling is performed at less than 5° C./sec, the average pearlite lamellar interval can be hardly adjusted to 0.20 μm or less. The average cooling rate in the third cooling is preferably 10° C./sec or more, more preferably 20° C./sec or more. The upper limit of the average cooling rate in the third cooling is not particularly limited, but it is practically 200° C./sec or less. In the third cooling, as long as the average cooling rate is 5° C./sec or more, cooling may be performed by changing the cooling rate. After performing the third cooling, cooling to room temperature may be executed by performing normal cooling such as standing to cool. The lower limit of the termination temperature of the third cooling is not particularly limited, but it is, for example, 200° C.

Above all, in the steel for a mechanical structure for cold working of the present invention, in order for the area ratio Af of pro-eutectoid ferrite to satisfy the relationship of Af≥A with A represented by the formula (1), the second cooling in the above-described manufacturing method of a steel for a mechanical structure for cold working is preferably controlled more strictly.

Specifically, it is preferable to perform finish rolling of the steel satisfying the above-described chemical component composition at a temperature of 800° C. or more and less than 1,100° C., perform, in the following order, first cooling at an average cooling rate of 7° C./sec or more, second cooling at an average cooling rate of 1° C./sec or more and 5° C./sec or less and not more than CR° C./sec represented by the following formula (2), and third cooling at an average cooling rate of higher than that in the second cooling and 5° C./sec or more, perform termination of the first cooling and start of the second cooling in the range of 700 to 750° C., perform termination of the second cooling and start of the third cooling in the range of 600 to 650° C., and perform termination of the third cooling at 400° C. or less:

$$CR=-0.06\times T-60\times[C\%]+94(^\circ\ C./sec) \quad (2)$$

wherein in formula (2), T indicates the temperature (° C.) of the finish rolling, and [C%] indicates the C content in mass %.

The finish rolling temperature and the first cooling and third cooling are the same as in the above-described manufacturing method, and the second cooling is described in detail below.

(e) Second Cooling

For equiaxing the pro-eutectoid ferrite grain, i.e., in order for the pro-eutectoid ferrite grain to have an average aspect ratio of 3.0 or less, and furthermore, in order for the area ratio Af of pro-eutectoid ferrite to satisfy the relationship of Af≥A, it is preferable to perform slow cooling in the temperature region where pro-eutectoid ferrite precipitates. However, the critical maximum cooling rate in the second cooling for obtaining the desired area ratio of pro-eutectoid ferrite is determined by the carbon concentration and the finish rolling temperature. More specifically, as the carbon concentration is higher, the pearlite area ratio is increased and in turn, the pro-eutectoid ferrite area ratio is decreased. In addition, as the finish temperature is higher, the transformation temperature during cooling lowers and the pro-eutectoid ferrite area ratio is decreased. The present inventors have clarified these relationships from numerous experiments and arrived at the formula (2). That is, in the second cooling starting in the temperature range of 700 to 750° C. and terminating in the temperature range of 600 to 650° C., it is preferable to perform slow cooling at an average cooling rate of 1° C./sec or more and 5° C./sec or less and not more than CR° C./sec represented by the formula (2). If the average cooling rate in the second cooling exceeds CR° C./sec, the requirement of Af≥A cannot be satisfied. As the lower limit of the average cooling rate in the second cooling, it is preferably 2° C./sec or more, more preferably 3° C./sec or more. The average cooling rate in the second cooling is preferably not more than (CR-0.5)° C./sec, more preferably not more than (CR-1)° C./sec, but this does not apply depending on the value of CR.

The steel for a mechanical structure for cold working of the present invention means a steel before spheroidizing annealing and is, for example, a rolled material such as steel bar or wire rod. In addition, the present invention encompasses a drawn wire rod obtained by performing drawing after rolling, i.e., a steel wire.

As for the steel wire of the present invention, after cooling the steel to room temperature by performing the third cooling, drawing work may be further performed at room temperature, and the area reduction ratio of drawing may be 30% or less. When the steel is drawn, the carbide therein is broken, and aggregation of carbide in the subsequent spheroidizing annealing can be promoted. Accordingly, drawing is effective in shortening the soaking treatment time of spheroidizing annealing. If the area reduction ratio of drawing work exceeds 30%, the strength after annealing may be increased to deteriorate the cold workability. For this reason, the area reduction ratio of drawing work is preferably 30% or less. As the upper limit of the area reduction ratio of drawing work, it is preferably 25% or less, more preferably 20% or less. The lower limit of the area reduction ratio of drawing work is not particularly limited, but the effect is obtained when it is 2% or more. As the lower limit of the area reduction ratio of drawing work, it is preferably 4% or more, more preferably 6% or more.

When the steel of the present invention is used, during performing short-time spheroidizing annealing, for example, spheroidizing annealing for 1 to 3 hours in the temperature range of approximately from Ac1 to Ac1+30° C., the spheroidizing degree can be reduced to be 2.5 or less in the case of, for example, a steel species having a C content of about 0.45%. When the spheroidizing degree is 2.5 or less, cracking resistance during cold working is enhanced.

EXAMPLES

The present invention is described more specifically below by referring to Examples. The present invention is not limited to Examples below and can be of course implemented by appropriately adding changes within the range adaptable to the purposes described above and below, and all of these changes are encompassed by the technical scope of the present invention.

A wire rod of ϕ10.0 mm was manufactured using the steel having a chemical component composition shown in Table 1 below, and furthermore, a working F test piece of ϕ8.0 mm×12.0 mm was obtained using a working Formastor (hereinafter, referred to as "working F") testing apparatus of laboratory. Here, with respect to No. 4 in Table 2 described later, a wire rod obtained by rolling was used, and with respect to Nos. 19 and 20 in Table 2, a drawn wire rod obtained by further performing drawing after rolling was used. With respect to Nos. 4, 19 and 20, the "Working Conditions" in Table 2 means rolling conditions. With respect to the working F test piece shown in Tables 2 and 4, the working conditions shown in the Tables are simulating the rolling conditions in an actual machine.

TABLE 1

| Steel | Chemical Component Composition (mass %) *Remainder being iron and unavoidable impurities | | | | | | | |
|---|---|---|---|---|---|---|---|---|
| Species | C | Si | Mn | P | S | Al | N | Others |
| A | 0.44 | 0.18 | 0.792 | 0.016 | 0.016 | 0.029 | 0.004 | — |
| B | 0.44 | 0.17 | 0.705 | 0.020 | 0.019 | 0.021 | 0.005 | — |
| C | 0.45 | 0.18 | 0.760 | 0.026 | 0.018 | 0.033 | 0.005 | — |
| D | 0.33 | 0.15 | 0.713 | 0.013 | 0.022 | 0.017 | 0.003 | — |
| E | 0.48 | 0.20 | 0.809 | 0.016 | 0.017 | 0.026 | 0.004 | Cr: 0.14 |
| F | 0.35 | 0.09 | 0.688 | 0.017 | 0.016 | 0.019 | 0.004 | Cu: 0.10, Ni: 0.08 |
| G | 0.45 | 0.12 | 0.662 | 0.018 | 0.020 | 0.048 | 0.010 | Mo: 0.22 |
| H | 0.36 | 0.21 | 0.803 | 0.007 | 0.020 | 0.023 | 0.002 | B: 0.0021 |
| I | 0.45 | 0.23 | 1.840 | 0.015 | 0.022 | 0.013 | 0.002 | — |
| J | 0.35 | 0.15 | 0.586 | 0.011 | 0.013 | 0.025 | 0.006 | — |
| K | 0.45 | 0.21 | 0.731 | 0.017 | 0.016 | 0.022 | 0.005 | — |
| L | 0.56 | 0.16 | 0.688 | 0.013 | 0.010 | 0.033 | 0.005 | Cr: 0.17, Cu: 0.06 |

With respect to the obtained wire rod, drawn wire rod or work F test piece, the microstructure was evaluated in the manner of following (1) to (5) and the spheroidizing degree and hardness after spheroidizing annealing were measured. With respect to Nos. 19 and 20 in Table 2, which are a drawn wire rod, the microstructure was evaluated in the state of a wire rod before drawing. In any of the measurements, each of the wire rod, drawn wire rod and working F test piece was embedded in a resin so that the longitudinal cross-section, i.e., the cross-section parallel to the axis, can be observed, and the position of D/4 of the wire rod, etc. was measured. Here, D means the diameter of the wire rod, etc.

(1) Observation of Microstructure

In the measurements of the total area ratio of ferrite and pearlite relative to the total microstructure and the average aspect ratio and area ratio of the pro-eutectoid ferrite grain, the microstructure was exposed by nital etching, and 5 visual fields each being a visual field of 220 μm×165 μm were observed and photographed at a magnification of 400 times by means of an optical microscope. Based on the photos obtained, the total area ratio of ferrite and pearlite and the aspect ratio of pro-eutectoid ferrite grain were measured by image analysis, and respective average values were calculated. In the measurement of the aspect ratio of pro-eutectoid ferrite grain, the number of grains measured was a total of 100 or more for each material. In the measurement of the area ratio of pro-eutectoid ferrite, 10 vertical lines and 10 horizontal lines at equal intervals were drawn in a grid pattern, and the number of points of pro-eutectoid ferrite present on 100 intersection points was measured. The number of points of pro-eutectoid ferrite in each visual field is defined as the area ratio (%) of pro-eutectoid ferrite, and the average value was calculated.

(2) Measurement of Average bcc-Fe Grain Size Surrounded by Large-Angle Grain Boundary In the measurement of the average bcc-Fe grain size surrounded by a large-angle grain boundary, an EBSP analyzer and an FE-SEM (Field-Emission Scanning Electron Microscope) were used. Assuming that the boundary in which the crystal misorientation (oblique angle) exceeds 15°, i.e., the large-angle grain boundary, is the grain boundary, the "grain" was defined, and the average grain size of the bcc-Fe grain was determined. At this time, the grain size was measured in a measurement region of 200 μm×400 μm in steps of 1.0 μm, and a measurement point in which the Confidence Index indicating the reliability of measured orientation is 0.1 or less was removed from the object of analysis.

(3) Measurement of Pearlite Lamellar Interval in Narrowest Part

Figure 1B:
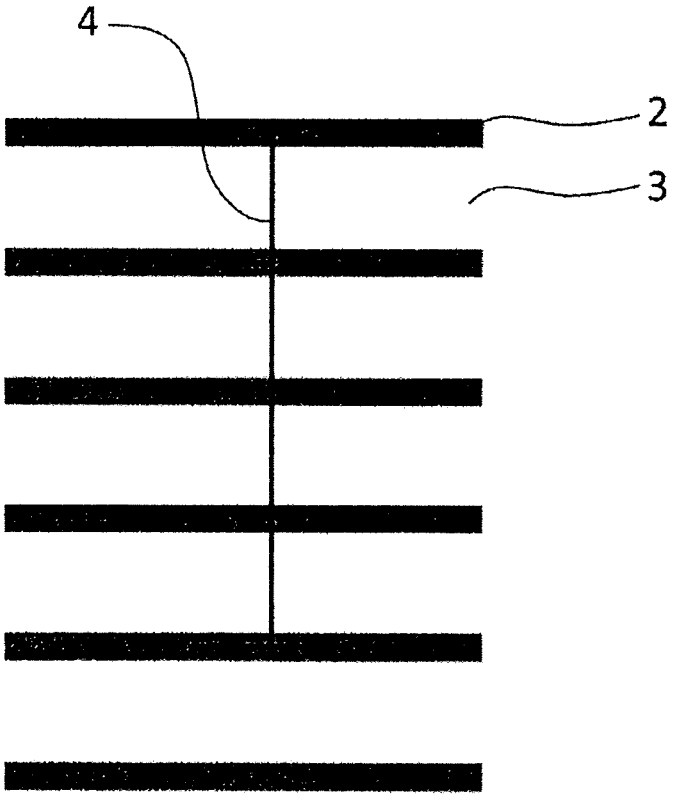

FIG. 1A is a schematic view illustrating a lamellar microstructure 1 of pearlite, and FIG. 1B is an enlarged view of the lamellar microstructure 1. The lamellar microstructure 1 of pearlite is a microstructure where, as illustrated in FIG. 1B, lamellar ferrite 3 and lamellar cementite 2 are aligned in layers (lamellarly), and the lamellar interval specified in the present invention is the interval of the lamellar cementite 2. A mirror-polished longitudinal cross-section sample was subjected to picral etching to expose the microstructure, the structure at the D/4 position was observed using FE-SEM, and a total of 5 visual fields were photographed at a magnification of 3,000 times for a region of 42 μm×28 μm or at a magnification of 5,000 times for a region of 25 μm×17 μm. At this time, each visual field was adjusted to contain at least one pearlite. In each visual field of the photos photographed, pearlite at finest lamellar intervals was selected, a line segment 4 running at right angles to the lamellar microstructure and having start/terminal ends located at the thickness center of lamellar cementite was drawn, the length L of line segment and the number n of rows of lamellar cementite involved in the line segment (the number n of rows includes lamellar cementite at start/terminal ends) were measured, and the lamellar interval λ was calculated using formula (3). At this time, n was set to 5 or more.

$$\lambda = L/(n-1) \tag{3}$$

(4) Measurement of Spheroidizing Degree After Spheroidizing Annealing

The measurement of the spheroidizing degree after spheroidizing annealing was performed by exposing the microstructure by nital etching and observing 5 visual fields at a magnification of 400 times by means of an optical microscope. The spheroidizing degree was evaluated by No. 1 to No. 4 in the appended diagram of JIS G3539:1991, and an average value of 5 visual fields was calculated. When the average value is not an integer, a numerical value obtained by rounding down to the nearest whole digit and adding 0.5 was defined as the spheroidizing degree. The smaller spheroidizing degree indicates a better spheroidized microstructure.

(5) Measurement of Hardness After Spheroidizing Annealing

In the measurement of hardness HV after spheroidizing annealing, 5 points were measured using a Vickers hardness tester under 1 kgf load, and the average value thereof was determined.

Example 1

Using Steel Species A shown in Table 1, each of samples differing in the pre-microstructure, i.e., a rolled material, a drawn wire rod and a working F test piece, was manufactured by changing the working temperature (corresponding to the finish rolling temperature) and the cooling rate as shown in Table 2 below. In the production conditions of Table 2, "First Cooling" means cooling starting at the working temperature and terminating in the temperature range of 700 to 750° C.; "Second Cooling" means cooling starting at the termination temperature of "First Cooling" and terminating in the temperature range of 600 to 650° C.; and "Third Cooling" means cooling starting at the termination temperature of "Second Cooling" and terminating at a temperature of 400° C. or less. In all cases, after the termination of third cooling, the sample was left standing to cool to room temperature, and with respect to Nos. 19 and 20, a drawing treatment was further applied afterward.

In Table 2, as to the cooling termination temperature, "-" indicates that the sample was continuously cooled by keeping the cooling rate unchanged, i.e., cooling was continued without changing the cooling rate. For example, in No. 13, first cooling and second cooling were continuous, and the sample was cooled at 10° C./s in 1,050° C.→640° C. and cooled at 20° C./s in 640° C.→300° C. In No. 16, first cooling to third cooling were continuous, and the sample was cooled at 10° C./s in 1,000° C.→300° C.

TABLE 2

| | | Working Conditions | | | | | | | | |
|---|---|---|---|---|---|---|---|---|---|---|
| | | Heating | First Cooling | | Second Cooling | | Third Cooling | | | |
| Test No. | Steel Species | Working Temperature (° C.) | Average Cooling Rate (° C./s) | Termination Temperature (° C.) | Average Cooling Rate (° C./s) | Termination Temperature (° C.) | Average Cooling Rate (° C./s) | Termination Temperature (° C.) | Drawing Area Reduction Ratio (%) | Sample Manufacturing Method |
| 1 | A | 1050 | 10 | 720 | 1 | 620 | 10 | 300 | — | working F |
| 2 | A | 1050 | 20 | 720 | 1 | 620 | 10 | 300 | — | working F |
| 3 | A | 1000 | 10 | 720 | 3 | 620 | 5 | 300 | — | working F |
| 4 | A | 1000 | 10 | 740 | 5 | 640 | 10 | 300 | — | rolling |
| 5 | A | 950 | 10 | 720 | 1 | 620 | 20 | 300 | — | working F |
| 6 | A | 950 | 10 | 740 | 3 | 640 | 10 | 300 | — | working F |
| 7 | A | 900 | 10 | 740 | 3 | 640 | 10 | 300 | — | working F |
| 8 | A | 800 | 10 | 720 | 1 | 620 | 10 | 300 | — | working F |
| 9 | A | 1200 | 10 | 720 | 1 | 620 | 10 | 300 | — | working F |
| 10 | A | 1100 | 10 | 740 | 1 | 640 | 10 | 300 | — | working F |
| 11 | A | 1100 | 10 | — | 10 | — | 10 | 300 | — | working F |
| 12 | A | 1050 | 5 | 720 | 3 | 620 | 10 | 300 | — | working F |
| 13 | A | 1050 | 10 | — | 10 | 640 | 20 | 300 | — | working F |
| 14 | A | 1050 | 50 | — | 50 | — | 50 | 300 | — | working F |
| 15 | A | 1000 | 10 | 720 | 3 | — | 3 | 300 | — | working F |
| 16 | A | 1000 | 10 | — | 10 | — | 10 | 300 | — | working F |
| 17 | A | 950 | 10 | — | 10 | — | 10 | 300 | — | working F |
| 18 | A | 750 | 10 | 720 | 1 | 620 | 10 | 300 | — | working F |

TABLE 2-continued

| | | Working Conditions | | | | | | | | |
|---|---|---|---|---|---|---|---|---|---|---|
| | | Heating | First Cooling | | Second Cooling | | Third Cooling | | | |
| Test No. | Steel Species | Working Temperature (° C.) | Average Cooling Rate (° C./s) | Termination Temperature (° C.) | Average Cooling Rate (° C./s) | Termination Temperature (° C.) | Average Cooling Rate (° C./s) | Termination Temperature (° C.) | Drawing Area Reduction Ratio (%) | Sample Manufacturing Method |
| 19 | A | 1000 | 10 | 740 | 5 | 640 | 10 | 300 | 13.4 | rolling + drawing |
| 20 | A | 1000 | 10 | 740 | 5 | 640 | 10 | 300 | 21.9 | rolling + drawing |

The working Formastor test specimen had a size of ϕ8.0 mm×12.0 mm and after the completion of heat treatment, divided into 8 equal parts. One of these parts was used as a sample for microstructure examination, and another one was used as a sample for spheroidizing annealing. The spheroidizing annealing was performed by sealing each sample in vacuum and applying a heat treatment of (i) or (ii) in an atmospheric furnace:

(i) a heat treatment where after keeping the soaking at Ac1+20° C. for 2 hours, the sample was cooled to 640° C. at an average cooling rate of 10° C./hour and then left standing to cool (in the Table, denoted by SA1);

(ii) a heat treatment where after keeping the soaking at Ac1+5° C. for 2 hours, the sample was cooled to 640° C. at an average cooling rate of 10° C./hour and then left standing to cool (in the Table, denoted by SA2).

As Ac1, a value calculated according to the following formula was used. In the following formula, (% element name) means the content in mass % of each element.

$$Ac1(^\circ\ C.)=723-10.7(\%Mn)-16.9(\%Ni)+29.1(\%Si)+16.9(\%Cr)$$

The microstructure before spheroidizing annealing and the spheroidizing degree and hardness after spheroidizing annealing, which were evaluated in the manner of (1) to (5) above, are shown in Table 3. The standards of spheroidizing degree and hardness in Steel Species A having a C content of 0.44% are a spheroidizing degree of 2.5 or less and a hardness of 144 HV or less.

TABLE 3

| | Microstructure Before Annealing | | | | | Microstructure After Annealing | |
|---|---|---|---|---|---|---|---|
| Test No. | Area Ratio of Ferrite + Pearlite(%) | Average bcc-Fe Grain Size of Large-Angle Grain Boundary (μm) | Average Pearlite Lamellar Interval (μm) | Average Aspect Ratio of Pro-eutectoid Ferrite | Annealing Condition | Spheroidizing Degree | Hardness (HV) |
| 1 | 100 | 13.8 | 0.18 | 2.1 | SA1 | 2.5 | 139.5 |
| | | | | | SA2 | 2.5 | 143.8 |
| 2 | 100 | 12.5 | 0.16 | 1.9 | SA1 | 2.5 | 143.5 |
| 3 | 100 | 11.3 | 0.19 | 2.0 | SA1 | 2.5 | 143.9 |
| 4 | 100 | 11.2 | 0.17 | 2.5 | SA1 | 2.0 | 143.4 |
| | | | | | SA2 | 2.5 | 144.0 |
| 5 | 100 | 8.9 | 0.12 | 1.8 | SA1 | 1.5 | 141.7 |
| | | | | | SA2 | 2.5 | 143.4 |
| 6 | 100 | 8.8 | 0.13 | 1.9 | SA1 | 1.5 | 142.4 |
| 7 | 100 | 8.2 | 0.13 | 2.4 | SA1 | 1.5 | 142.9 |
| 8 | 100 | 5.2 | 0.16 | 2.2 | SA1 | 1.5 | 143.7 |
| 9 | 100 | 27.6 | 0.20 | 2.2 | SA1 | 4.0 | 148.9 |
| 10 | 100 | 18.8 | 0.20 | 2.8 | SA1 | 3.5 | 144.4 |
| 11 | 100 | 18.5 | 0.19 | 3.6 | SA1 | 3.0 | 145.8 |
| 12 | 100 | 15.4 | 0.17 | 2.1 | SA1 | 3.0 | 142.1 |
| 13 | 100 | 13.8 | 0.20 | 3.2 | SA1 | 2.0 | 147.6 |
| 14 | 88 | 3.8 | 0.06 | 4.2 | SA1 | 2.0 | 148.0 |
| 15 | 100 | 11.3 | 0.24 | 2.0 | SA1 | 3.0 | 147.1 |
| 16 | 100 | 11.2 | 0.19 | 3.1 | SA1 | 2.5 | 147.1 |
| 17 | 100 | 8.9 | 0.13 | 3.2 | SA1 | 1.5 | 146.6 |
| 18 | 100 | 4.1 | 0.18 | 2.2 | SA1 | 1.5 | 147.2 |
| 19 | 100 | 10.3 | 0.18 | 2.7 | SA1 | 2.5 | 142.9 |
| 20 | 100 | 10.2 | 0.20 | 2.9 | SA1 | 2.0 | 143.5 |

The results of Table 3 lead to the following discussions. In all of Nos. 1 to 8 not subjected to drawing and Test Nos. 19 and 20 subjected to drawing, which are examples satisfying all requirements specified in the present invention, even by a short-time spheroidizing treatment such as SA1 or SA2, the spheroidizing degree after spheroidizing annealing was good, and softening could be achieved.

On the other hand, in Nos. 9 to 18 which are examples failing in satisfying any one of the requirements specified in the present invention, at least either the spheroidizing degree or the hardness after spheroidizing annealing did not meet the standard. In Nos. 9 to 11 which are examples where the working temperature (corresponding to the finish rolling temperature) is high, the average bcc-Fe grain size surrounded by a large-angle grain boundary was increased. Furthermore, in No. 11 where the cooling rate in the second cooling is also high, the average aspect ratio of pro-eutectoid ferrite was increased. Accordingly, in all of Nos. 9 to 11, the spheroidizing degree after spheroidizing annealing was bad, and the hardness remained high. In No. 18 which is an example where the working temperature is low, the average bcc-Fe grain size surrounded by a large-angle grain boundary was reduced, as a result, the hardness after spheroidizing annealing remained high.

In No. 12 which is an example where the cooling rate in the first cooling is low, the average bcc-Fe grain size surrounded by a large-angle grain boundary was increased, as a result, the spheroidizing degree after spheroidizing annealing was bad. When the spheroidizing degree is high, the cracking resistance at the time of cold working deteriorates. In Nos. 13, 14, 16 and 17 which are examples where the cooling rate in the second cooling is high, the average aspect ratio of pro-eutectoid ferrite was increased, and the hardness after spheroidizing annealing remained high. In No. 14 which is an example where the cooling rate in the second cooling is particularly high, the area ratios of pro-eutectoid ferrite and pearlite became insufficient due to precipitation of a supercooled microstructure, which is also a factor particularly for a rise in the hardness after spheroidizing annealing. In No. 15 which is an example where the cooling rate in the third cooling is low, the average pearlite lamellar interval was increased, the spheroidizing degree after spheroidizing annealing was bad, and the hardness remained high.

Example 2

Using Steel Species B to I shown in Table 1, each of samples differing in the pre-microstructure was manufactured in the same manner as in Example 1 by using a working Formastor testing apparatus of laboratory and changing the working temperature (corresponding to the finish rolling temperature) and cooling rate as shown in Table 4 below. In Table 4, First Cooling to Third Cooling have the same meanings as in Table 2.

TABLE 4

| | | Working Conditions | | | | | | | |
|---|---|---|---|---|---|---|---|---|---|
| | | Heating | First Cooling | | Second Cooling | | Third Cooling | | |
| Test No. | Steel Species | Working Temperature (° C.) | Average Cooling Rate (° C./s) | Termination Temperature (° C.) | Average Cooling Rate (° C./s) | Termination Temperature (° C.) | Average Cooling Rate (° C./s) | Termination Temperature (° C.) | Sample Manufacturing Method |
| 21 | B | 1000 | 10 | 740 | 5 | 640 | 10 | 300 | working F |
| 22 | B | 950 | 10 | 740 | 3 | 640 | 10 | 300 | working F |
| 23 | C | 1000 | 10 | 740 | 5 | 640 | 10 | 300 | working F |
| 24 | D | 1000 | 10 | 740 | 5 | 640 | 10 | 300 | working F |
| 25 | D | 900 | 10 | 740 | 3 | 640 | 10 | 300 | working F |
| 26 | E | 1050 | 10 | 720 | 1 | 620 | 10 | 300 | working F |
| 27 | E | 950 | 10 | 720 | 1 | 620 | 20 | 300 | working F |
| 28 | F | 1000 | 10 | 740 | 5 | 640 | 10 | 300 | working F |
| 29 | G | 1050 | 10 | 720 | 1 | 620 | 10 | 300 | working F |
| 30 | G | 800 | 10 | 720 | 1 | 620 | 10 | 300 | working F |
| 31 | H | 1050 | 10 | 720 | 1 | 620 | 10 | 300 | working F |
| 32 | B | 1100 | 10 | 740 | 1 | 640 | 10 | 300 | working F |
| 33 | B | 1000 | 10 | 720 | 3 | — | 3 | 300 | working F |
| 34 | C | 1050 | 5 | 720 | 3 | 620 | 10 | 300 | working F |
| 35 | D | 1050 | 5 | 720 | 3 | 620 | 10 | 300 | working F |
| 36 | F | 950 | 10 | — | 10 | — | 10 | 300 | working F |
| 37 | G | 750 | 10 | 720 | 1 | 620 | 10 | 300 | working F |
| 38 | I | 1000 | 10 | 740 | 5 | 640 | 10 | 300 | working F |

With respect to these test pieces, the pre-microstructure was evaluated in the same manner as in Example 1 and by performing spheroidizing annealing in the same manner as in Example 1, the spheroidizing degree after spheroidizing annealing was evaluated. The results are shown in Table 5. The standard for the spheroidizing degree after spheroidizing annealing is 2.5 or less in all, and the standard for the hardness after spheroidizing annealing is HV134 or less for the steel species having a C content of 0.33%, i.e., Steel Species D, HV136 or less for the steel species having a C content of 0.34 to 0.36%, i.e., Steel Species F and H, HV144 or less for the steel species having a C content of 0.44 to 0.45%, i.e., Steel Species B, C, G and I, and HV148 or less for the steel species having a C content of 0.48%, i.e., Steel Species E.

TABLE 5

| | Microstructure Before Annealing | | | | | Microstructure After Annealing | |
|---|---|---|---|---|---|---|---|
| Test No. | Area Ratio of Ferrite + Pearlite (%) | Average bcc-Fe Grain Size of Large-Angle Grain Boundary (μm) | Average Pearlite Lamellar Interval (μm) | Average Aspect Ratio of Pro-eutectoid Ferrite | Annealing Condition | Spheroidizing Degree | Hardness (HV) |
| 21 | 100 | 11.4 | 0.18 | 2.4 | SA 1 | 2.5 | 142.8 |
| | | | | | SA 2 | 2.5 | 144.0 |
| 22 | 100 | 8.6 | 0.12 | 2.1 | SA 1 | 1.5 | 143.7 |
| | | | | | SA 2 | 2.5 | 143.4 |
| 23 | 100 | 10.7 | 0.19 | 2.5 | SA 1 | 2.5 | 143.1 |
| 24 | 100 | 12.3 | 0.17 | 2.8 | SA 1 | 2.5 | 132.1 |
| 25 | 100 | 8.4 | 0.14 | 2.5 | SA 1 | 1.5 | 133.2 |
| | | | | | SA 2 | 2.5 | 133.8 |
| 26 | 95 | 12.9 | 0.17 | 1.9 | SA 1 | 2.5 | 146.6 |
| 27 | 92 | 10.6 | 0.14 | 2.2 | SA 1 | 2.5 | 147.8 |
| 28 | 100 | 13.7 | 0.18 | 2.4 | SA 1 | 2.5 | 135.5 |
| 29 | 100 | 13.5 | 0.16 | 2.5 | SA 1 | 2.5 | 144.0 |
| | | | | | SA 2 | 2.5 | 143.2 |
| 30 | 100 | 6.1 | 0.17 | 2.0 | SA 1 | 1.5 | 142.1 |
| 31 | 100 | 14.2 | 0.20 | 2.2 | SA 1 | 2.5 | 134.7 |
| 32 | 100 | 16.6 | 0.20 | 2.4 | SA 1 | 3.5 | 141.2 |
| 33 | 100 | 12.3 | 0.23 | 1.9 | SA 1 | 3.0 | 144.6 |
| 34 | 100 | 15.5 | 0.24 | 2.3 | SA 1 | 3.0 | 143.7 |
| 35 | 100 | 16.1 | 0.21 | 2.3 | SA 1 | 3.5 | 132.5 |
| 36 | 100 | 9.6 | 0.16 | 3.7 | SA 1 | 2.0 | 138.9 |
| 37 | 100 | 4.4 | 0.15 | 2.7 | SA 1 | 2.0 | 149.2 |
| 38 | 100 | 11.5 | 0.18 | 2.7 | SA 1 | 2.5 | 151.6 |

The results of Table 5 lead to the following discussions. In all of Test Nos. 21 to 31 which are examples satisfying all requirements specified in the present invention, even by a short-time spheroidizing treatment such as SA1 or SA2, the spheroidizing degree after spheroidizing annealing was good, and softening could be achieved.

On the other hand, in Nos. 32 to 38 which are examples failing in satisfying any one of the requirements specified in the present invention, at least either the spheroidizing degree or the hardness after spheroidizing annealing did not meet the standard. In No. 32 which is an example where the working temperature (corresponding to the finish rolling temperature) is high, the average bcc-Fe grain size surrounded by a large-angle grain boundary was large, and the spheroidizing degree after spheroidizing annealing was bad. In No. 37 which is an example where the working temperature is low, the average bcc-Fe grain size surrounded by a large-angle grain boundary was reduced, as a result, the hardness after spheroidizing annealing remained high.

In No. 33 which is an example where the cooling rate in the third cooling is low, the average pearlite lamellar interval was increased, the spheroidizing degree after spheroidizing annealing was bad, and the hardness after spheroidizing annealing remained high. In Nos. 34 and 35 which are examples where the cooling rate in the first cooling is low, the average bcc-Fe grain size surrounded by a large-angle grain boundary was large, and the spheroidizing degree after spheroidizing annealing remained bad. In No. 36 which is an example where the cooling rate in the second cooling is high, the average aspect ratio of pro-eutectoid ferrite was increased, and the hardness after spheroidizing annealing remained high. In No. 38 which is an example using Steel Species I having a large Mn content, the hardness after spheroidizing annealing remained high.

Example 3

Furthermore, in order to examine the effect of the area ratio of pro-eutectoid, using Steel Species J to L shown in Table 1, each of samples differing in the pre-microstructure was manufactured in the same manner as in Example 1 by using a working Formastor testing apparatus of laboratory and changing the working temperature (corresponding to the finish rolling temperature) and cooling rate as shown in Table 6 below. In Table 6, First Cooling to Third Cooling have the same meanings as in Table 2.

TABLE 6

| | | Working Conditions | | | | | | | | | |
|---|---|---|---|---|---|---|---|---|---|---|---|
| | | Heating | First Cooling | | Second Cooling | | Third Cooling | | Drawing | Remarks | |
| Test No. | Steel Species | Working Temperature (° C.) | Average Cooling Rate (° C./s) | Termination Temperature (° C.) | Average Cooling Rate (° C./s) | Termination Temperature (° C.) | Average Cooling Rate (° C./s) | Termination Temperature (° C.) | Area Reduction Ratio (%) | Second Cooling CR (° C./s) | Sample Manufacturing Method |
| 39 | J | 1050 | 20 | 740 | 1 | 640 | 10 | 300 | — | 10 | working F |
| 40 | J | 1050 | 20 | 740 | 5 | 640 | 10 | 300 | — | 10 | working F |
| 41 | J | 1050 | 20 | 740 | 10 | 640 | 10 | 300 | — | 10 | working F |
| 42 | J | 980 | 20 | 740 | 1 | 640 | 10 | 300 | — | 14.2 | working F |
| 43 | J | 980 | 20 | 740 | 3 | 640 | 10 | 300 | — | 14.2 | working F |
| 44 | J | 980 | 20 | 740 | 5 | 640 | 10 | 300 | — | 14.2 | working F |
| 45 | J | 910 | 20 | 740 | 1 | 640 | 10 | 300 | — | 18.4 | working F |
| 46 | J | 910 | 20 | 740 | 3 | 640 | 10 | 300 | — | 18.4 | working F |
| 47 | J | 910 | 20 | 740 | 5 | 640 | 10 | 300 | — | 18.4 | working F |
| 48 | K | 1050 | 20 | 740 | 1 | 640 | 10 | 300 | — | 4 | working F |
| 49 | K | 1050 | 20 | 740 | 5 | 640 | 10 | 300 | — | 4 | working F |
| 50 | K | 1050 | 20 | 740 | 10 | 640 | 10 | 300 | — | 4 | working F |
| 51 | K | 980 | 20 | 740 | 1 | 640 | 10 | 300 | — | 8.2 | working F |
| 52 | K | 980 | 20 | 740 | 5 | 640 | 10 | 300 | — | 8.2 | working F |
| 53 | K | 980 | 20 | 740 | 20 | 640 | 10 | 300 | — | 8.2 | working F |
| 54 | K | 910 | 20 | 740 | 1 | 640 | 10 | 300 | — | 12.4 | working F |
| 55 | K | 910 | 20 | 740 | 5 | 640 | 10 | 300 | — | 12.4 | working F |
| 56 | K | 910 | 20 | 740 | 20 | 640 | 10 | 300 | — | 12.4 | working F |
| 57 | L | 1050 | 20 | 740 | 1 | 640 | 10 | 300 | — | −2.6 | working F |
| 58 | L | 1050 | 20 | 740 | 3 | 640 | 10 | 300 | — | −2.6 | working F |
| 59 | L | 1050 | 20 | 740 | 5 | 640 | 10 | 300 | — | −2.6 | working F |
| 60 | L | 980 | 20 | 740 | 1 | 640 | 10 | 300 | — | 1.6 | working F |
| 61 | L | 980 | 20 | 740 | 3 | 640 | 10 | 300 | — | 1.6 | working F |
| 62 | L | 980 | 20 | 740 | 5 | 640 | 10 | 300 | — | 1.6 | working F |
| 63 | L | 910 | 20 | 740 | 1 | 640 | 10 | 300 | — | 5.8 | working F |
| 64 | L | 910 | 20 | 740 | 3 | 640 | 10 | 300 | — | 5.8 | working F |
| 65 | L | 910 | 20 | 740 | 5 | 640 | 10 | 300 | — | 5.8 | working F |

With respect to these test pieces, the pre-microstructure was evaluated in the same manner as in Example 1 and by performing spheroidizing annealing in the same manner as in Example 1, the spheroidizing degree after spheroidizing annealing was evaluated. The results are shown in Table 7. The standard for the spheroidizing degree after spheroidizing annealing is 2.5 or less for the steel species having a C content of 0.35 to 0.45%, i.e., Steel Species J and K, and 3.0 or less for the steel species having a C content of 0.56%, i.e., Steel Species L, and the standard for the hardness after spheroidizing annealing is HV136 or less for the steel species having a C content of 0.35%, i.e., Steel Species J, HV144 or less for the steel species having a C content of 0.45%, i.e., Steel Species K, and HV156 or less for the steel species having a C content of 0.56%, i.e., Steel Species L.

TABLE 7

| | Microstructure Before Annealing | | | | | | | Microstructure After Annealing | |
|---|---|---|---|---|---|---|---|---|---|
| Test No. | Area Ratio of Ferrite + Pearlite (%) | Average bcc-Fe Grain Size of Large-Angle Grain Boundary (μm) | Average Pearlite Lamellar Interval (μm) | Average Aspect Ratio of Pro-eutectoid Ferrite | Area Ratio Af of Pro-eutectoid Ferrite (%) | Area Ratio A (%) | Annealing Condition | Spheroidizing Degree | Hardness (HV) |
| 39 | 100 | 14.7 | 0.17 | 2.3 | 55 | 38 | SA1 | 2.5 | 132.2 |
| 40 | 100 | 14.2 | 0.14 | 2.6 | 43 | 38 | SA1 | 2.5 | 134.7 |
| 41 | 100 | 13.5 | 0.13 | 3.2 | 36 | 38 | SA1 | 2.5 | 138.3 |
| 42 | 100 | 12.9 | 0.17 | 2.1 | 57 | 38 | SA1 | 2.0 | 125.0 |
| 43 | 100 | 12.0 | 0.16 | 2.2 | 56 | 38 | SA1 | 2.0 | 131.1 |
| 44 | 100 | 11.6 | 0.17 | 2.2 | 49 | 38 | SA1 | 1.5 | 133.6 |
| 45 | 100 | 8.9 | 0.18 | 1.9 | 60 | 38 | SA1 | 1.5 | 126.9 |
| 46 | 100 | 8.6 | 0.18 | 2.0 | 51 | 38 | SA1 | 1.5 | 131.2 |
| 47 | 100 | 8.0 | 0.17 | 2.3 | 56 | 38 | SA1 | 1.0 | 132.5 |
| 48 | 100 | 14.4 | 0.18 | 2.4 | 34 | 30 | SA1 | 2.5 | 137.1 |
| 49 | 100 | 13.9 | 0.16 | 2.7 | 27 | 30 | SA1 | 2.5 | 143.7 |
| 50 | 100 | 13.2 | 0.15 | 3.4 | 16 | 30 | SA1 | 2.5 | 145.5 |
| 51 | 100 | 12.5 | 0.17 | 2.2 | 47 | 30 | SA1 | 2.5 | 139.3 |
| 52 | 100 | 11.6 | 0.16 | 2.3 | 36 | 30 | SA1 | 2.0 | 141.4 |
| 53 | 100 | 10.7 | 0.13 | 3.7 | 20 | 30 | SA1 | 2.0 | 146.8 |
| 54 | 100 | 10.6 | 0.18 | 2.1 | 51 | 30 | SA1 | 2.0 | 138.9 |
| 55 | 100 | 8.9 | 0.16 | 2.3 | 45 | 30 | SA1 | 1.5 | 141.2 |
| 56 | 100 | 8.7 | 0.14 | 3.2 | 24 | 30 | SA1 | 1.5 | 147.0 |
| 57 | 100 | 14.5 | 0.18 | 2.5 | 19 | 20 | SA1 | 3.0 | 152.3 |
| 58 | 100 | 14.0 | 0.17 | 2.7 | 6 | 20 | SA1 | 3.0 | 154.4 |

TABLE 7-continued

| | Microstructure Before Annealing | | | | | | | Microstructure After Annealing | |
|---|---|---|---|---|---|---|---|---|---|
| Test No. | Area Ratio of Ferrite + Pearlite (%) | Average bcc-Fe Grain Size of Large-Angle Grain Boundary (μm) | Average Pearlite Lamellar Interval (μm) | Average Aspect Ratio of Pro-eutectoid Ferrite | Area Ratio Af of Pro-eutectoid Ferrite (%) | Area Ratio A (%) | Annealing Condition | Spheroidizing Degree | Hardness (HV) |
| 59 | 100 | 14.0 | 0.14 | 2.8 | 3 | 20 | SA1 | 3.0 | 154.7 |
| 60 | 100 | 13.9 | 0.18 | 2.5 | 22 | 20 | SA1 | 3.0 | 147.8 |
| 61 | 100 | 12.8 | 0.16 | 2.4 | 10 | 20 | SA1 | 2.5 | 152.1 |
| 62 | 100 | 12.6 | 0.16 | 2.7 | 8 | 20 | SA1 | 2.0 | 155.4 |
| 63 | 100 | 8.2 | 0.20 | 2.3 | 34 | 20 | SA1 | 2.5 | 148.6 |
| 64 | 100 | 9.4 | 0.17 | 2.2 | 30 | 20 | SA1 | 2.5 | 147.9 |
| 65 | 100 | 7.8 | 0.17 | 2.4 | 25 | 20 | SA1 | 2.0 | 150.4 |

The results of Table 7 lead to the following discussions. In all of Nos. 39, 40, 42 to 49, 51, 52, 54, 55 and 57 to 65 which are examples satisfying all requirements specified in the present invention, even by a short-time spheroidizing treatment such as SA1, the spheroidizing degree after spheroidizing annealing was good, and softening could be achieved. Among these, in Nos. 39, 40, 42 to 48, 51, 52, 54, 55, 60 and 63 to 65 which are examples satisfying also the requirement of Af≥A that is a preferable requirement of the present invention, even by a short-time spheroidizing treatment such as SA1, the spheroidizing degree after spheroidizing annealing was good, and further softening could be achieved.

On the other hand, in Nos. 49, 57 to 59, 61 and 62 which are examples where the cooling rate in the second cooling is higher than CR (° C./sec) of formula (2), the requirement Af≥A for the area ratio of pro-eutectoid ferrite specified in the present invention was not satisfied. Both the spheroidizing degree and hardness after spheroidizing annealing could meet the standard, but the hardness remained high, compared with an example satisfying the requirement for the area ratio of proeutectoid ferrite.

$$CR=-0.06\times T-60\times[C\%]+94(^\circ\ C./sec) \quad (2)$$

In Nos. 41, 50, 53 and 56 which are examples where the cooling rate in the second cooling is higher than 5 (° C./sec), the requirements for the average aspect ratio and area ratio of pro-eutectoid ferrite specified in the present invention were not satisfied and therefore, the hardness after spheroidizing annealing remained high.

While the invention has been described in detail and with reference to specific embodiments thereof, it will be apparent to one skilled in the art that various changes and modifications can be made therein without departing from the spirit and scope of the invention.

This application is based on Japanese Patent Application No. 2014-123430 filed on Jun. 16, 2014, and Japanese Patent Application No. 2015-056664 filed on Mar. 19, 2015, the contents of which are incorporated herein by way of reference.

INDUSTRIAL APPLICABILITY

The steel for a mechanical structure for cold working of the present invention can be softened by short-time spheroidizing annealing and is suitably used as a material for various components, such as machine component and electric component, e.g., bolt, screw, nut, socket, ball joint, inner tube, torsion bar, clutch case, cage, housing, hub, cover, case, receive washer, tappet, saddle, valve, inner case, clutch, sleeve, outer lace, sprocket, core, stator, anvil, spider, rocker arm, body, flange, drum, joint, connector, pulley, metal fitting, yoke, mouthpiece, valve lifter, spark plug, pinion gear, steering shaft, common rail, and useful in industry.

DESCRIPTION OF REFERENCE NUMERALS AND SIGNS

1 Pearlite lamellar microstructure
2 Lamellar cementite
3 Lamellar ferrite
4 Line segment running at right angles to the lamellar microstructure and having start/terminal ends located at the thickness center

The invention claimed is:

1. A steel for a mechanical structure for cold working, the steel comprising, in mass %:
C: from 0.3 to 0.6%;
Si: from 0.05 to 0.5%;
Mn: from 0.2 to 1.7%;
P: more than 0% and 0.03% or less;
S: from 0.001 to 0.05%;
Al: from 0.01 to 0.1%;
N: from 0 to 0.015%; and
iron and unavoidable impurities,
wherein:
the steel has a metal microstructure comprising pearlite and ferrite, with a total area ratio of the pearlite and the ferrite being 92% or more relative to the total microstructure;
an average equivalent-circle diameter of a bcc-Fe grain surrounded by a large-angle grain boundary having a misorientation of more than 15° between two neighboring grains is from 5 to 15 μm;
an average aspect ratio of pro-eutectoid ferrite grains is 3.0 or less; and
an average narrowest pearlite lamellar interval is 0.20 μm or less.

2. The steel according to claim 1, further comprising at least one selected from the group consisting of, in mass %
Cr: more than 0% and 0.5% or less,
Cu: more than 0% and 0.25% or less,
Ni: more than 0% and 0.25% or less,
Mo: more than 0% and 0.25% or less, and
B: more than 0% and 0.01% or less.

3. The steel according to claim 1, wherein an area ratio Af of pro-eutectoid ferrite, in terms of the percentage relative to the total microstructure, has a relationship of Af≥A with A represented by the following formula (1):

$$A=(103-128\times[C\%])\times 0.65(\%) \quad (1)$$

where [C%] represents the C content in mass %.

4. The steel according to claim 1, wherein the total area ratio of the pearlite and the ferrite is 95% or more relative to the total microstructure.

5. The steel according to claim 1, wherein the average equivalent-circle diameter of a bcc-Fe grain surrounded by a large-angle grain boundary having a misorientation of more than 15° between two neighboring grains is from 5 to 14.7 μm.

6. The steel according to claim 1, wherein the average equivalent-circle diameter of a bcc-Fe grain surrounded by a large-angle grain boundary having a misorientation of more than 15° between two neighboring grains is from 5 to 14 μm.

7. A steel wire obtained by further applying drawing to the steel according to claim 1.

8. The steel according to claim 2, wherein an area ratio Af of pro-eutectoid ferrite, in terms of the percentage relative to the total microstructure, has a relationship of Af≥A with A represented by formula (1):

$$A=(103-128\times[C\%])\times 0.65(\%) \quad (1)$$

where [C%] represents the C content in mass %.

9. A steel wire obtained by further applying drawing to the steel according to claim 2.

10. A steel wire obtained by further applying drawing to the steel according to claim 3.

11. A steel wire obtained by further applying drawing to the steel according to claim 8.

12. A method for manufacturing the steel according to claim 1, the method comprising:

performing finish rolling at a temperature of 800° C. or more and less than 1,100° C.; and performing, in the following order, first cooling at an average cooling rate of 7° C./sec or more to a first cooling termination temperature range of 700 to 750° C., second cooling at an average cooling rate of 1° C./sec or more and 5° C./sec or less to a second cooling termination temperature range of 600 to 650° C., and third cooling at an average cooling rate of higher than that in the second cooling and 5° C./sec or more to a third cooling termination temperature range of 400° C. or less, wherein the second cooling starts at the first cooling termination temperature range and the third cooling starts at the second cooling termination temperature range.

13. A method for manufacturing the steel wire as described in claim 7, the method comprising:

performing finish rolling at a temperature of 800° C. or more and less than 1,100° C.;

performing, in the following order, first cooling at an average cooling rate of 7° C./sec or more to a first cooling termination temperature range of 700 to 750° C., second cooling at an average cooling rate of 1° C./sec or more and 5° C./sec or less to a second cooling termination temperature range of 600 to 650° C., and third cooling at an average cooling rate of higher than that in the second cooling and 5° C./sec or more to a third cooling termination temperature range of 400° C. or less, thereby obtaining steel for a mechanical structure for cold working; and subjecting the steel for a mechanical structure for cold working to drawing work with an area reduction ratio of 30% or less, wherein the second cooling starts at the first cooling termination temperature range and the third cooling starts at the second cooling termination temperature range.

14. A method for manufacturing the steel according to claim 2, the method comprising:

performing finish rolling at a temperature of 800° C. or more and less than 1,100° C.; and performing, in the following order, first cooling at an average cooling rate of 7° C./sec or more to a first cooling termination temperature range of 700 to 750° C., second cooling at an average cooling rate of 1° C./sec or more and 5° C./sec or less to a second cooling termination temperature range of 600 to 650° C., and third cooling at an average cooling rate of higher than that in the second cooling and 5° C./sec or more to a third cooling termination temperature range of 400° C. or less, wherein the second cooling starts at the first cooling termination temperature range and the third cooling starts at the second cooling termination temperature range.

15. A method for manufacturing the steel according to claim 3, the method comprising:

performing finish rolling at a temperature of 800° C. or more and less than 1,100° C.; and performing, in the following order, first cooling at an average cooling rate of 7° C./sec or more to a first cooling termination temperature range of 700 to 750° C., second cooling at an average cooling rate of 1° C./sec or more and 5° C./sec or less and not more than CR° C./sec represented by formula (2) to a second cooling termination temperature range of 600 to 650° C., and third cooling at an average cooling rate of higher than that in the second cooling and 5° C./sec or more to a third cooling termination temperature range of 400° C. or less:

$$CR=-0.06\times T-60\times[C\%]+94(^\circ\ C./sec) \quad (2)$$

where T represents the finish rolling temperature in ° C., and [C%] represents the C content in mass %, wherein the second cooling starts at the first cooling termination temperature range and the third cooling starts at the second cooling termination temperature range.

16. A method for manufacturing the steel according to claim 8, the method comprising:

performing finish rolling at a temperature of 800° C. or more and less than 1,100° C.; and performing, in the following order, first cooling at an average cooling rate of 7° C./sec or more to a first cooling termination temperature range of 700 to 750° C., second cooling at an average cooling rate of 1° C./sec or more and 5° C./sec or less and not more than CR° C./sec represented by formula (2) to a second cooling termination temperature range of 600 to 650° C., and third cooling at an average cooling rate of higher than that in the second cooling and 5° C./sec or more to a third cooling termination temperature range of 400° C. or less:

$$CR=-0.06\times T-60\times[C\%]+94(^\circ\ C./sec) \quad (2)$$

where T represents the finish rolling temperature in ° C., and [C%] represents the C content in mass %, wherein the second cooling starts at the first cooling termination temperature range and the third cooling starts at the second cooling termination temperature range.

17. A method for manufacturing the steel wire according to claim 11, the method comprising:

performing finish rolling at a temperature of 800° C. or more and less than 1,100° C.;

performing, in the following order, first cooling at an average cooling rate of 7° C./sec or more to a first cooling termination temperature range of 700 to 750° C., second cooling at an average cooling rate of 1° C./sec or more and 5° C./sec or less and not more than CR° C./sec represented by formula (2) to a second cooling termination temperature range of 600 to 650° C., and third cooling at an average cooling rate of higher than that in the second cooling and 5° C./sec or more to a third cooling termination temperature range of 400° C. or less:

$$CR=-0.06\times T-60\times[C\%]+94(^\circ\ C./sec) \quad (2)$$

where T represents the finish rolling temperature in ° C., and [C%] represents the C content in mass %, thereby obtaining steel for a mechanical structure for cold working; and subjecting the steel for a mechanical structure for cold working to drawing work with an area reduction ratio of 30% or less, wherein the second cooling starts at the first cooling termination temperature range and the third cooling starts at the second cooling termination temperature range.

18. A method for manufacturing the steel wire according to claim 9, the method comprising:

performing finish rolling at a temperature of 800° C. or more and less than 1,100° C.;

performing, in the following order, first cooling at an average cooling rate of 7° C./sec or more to a first cooling termination temperature range of 700 to 750° C., second cooling at an average cooling rate of 1° C./sec or more and 5° C./sec or less to a second cooling termination temperature range of 600 to 650° C., and third cooling at an average cooling rate of higher than that in the second cooling and 5° C./sec or more to a third cooling termination temperature range of 400° C. or less, thereby obtaining steel for a mechanical structure for cold working; and subjecting the steel for a mechanical structure for cold working to drawing work with an area reduction ratio of 30% or less, wherein the second cooling starts at the first cooling termination temperature range and the third cooling starts at the second cooling termination temperature range.

19. A method for manufacturing the steel wire according to claim 10, the method comprising:

performing finish rolling at a temperature of 800° C. or more and less than 1,100° C.;

performing, in the following order, first cooling at an average cooling rate of 7° C./sec or more to a first cooling termination temperature range of 700 to 750° C., second cooling at an average cooling rate of 1° C./sec or more and 5° C./sec or less and not more than CR° C./sec represented by formula (2) to a second cooling termination temperature range of 600 to 650° C., and third cooling at an average cooling rate of higher than that in the second cooling and 5° C./sec or more to a third cooling termination temperature range of 400° C. or less:

$$CR=-0.06\times T-60\times[C\%]+94(^\circ\ C./sec) \quad (2)$$

where T represents the finish rolling temperature in ° C., and [C%] represents the C content in mass %, thereby obtaining steel for a mechanical structure for cold working; and subjecting the steel for a mechanical structure for cold working to drawing work with an area reduction ratio of 30% or less, wherein the second cooling starts at the first cooling termination temperature range and the third cooling starts at the second cooling termination temperature range.

* * * * *